US011434906B2

(12) United States Patent
Iser

(10) Patent No.: US 11,434,906 B2
(45) Date of Patent: Sep. 6, 2022

(54) VANE CELL PUMP COMPRISING A PRESSURE EQUALIZATION CONNECTION

(71) Applicant: Schwäbische Hüttenwerke Automotive GmbH, Wasseralfingen (DE)

(72) Inventor: Tobias Iser, Elchingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 16/857,316

(22) Filed: Apr. 24, 2020

(65) Prior Publication Data

US 2020/0340474 A1 Oct. 29, 2020

(30) Foreign Application Priority Data

Apr. 26, 2019 (DE) ..... 10 2019 110 905.1

(51) Int. Cl.
*F03C 2/00* (2006.01)
*F03C 4/00* (2006.01)
(Continued)

(52) U.S. Cl.
CPC ..... *F04C 14/22* (2013.01); *F04C 2/3442* (2013.01); *F04C 15/0023* (2013.01); *F04C 2210/14* (2013.01); *F04C 2240/20* (2013.01)

(58) Field of Classification Search
CPC ..... F04C 2/344; F04C 2/3442; F04C 14/22; F04C 14/223; F04C 14/24; F04C 14/28;
(Continued)

(56) References Cited

U.S. PATENT DOCUMENTS 3,565,558 A * 2/1971 Tobacman ..... F01C 21/0809 418/150
6,068,461 A * 5/2000 Haga ..... F04C 15/0049 418/180
(Continued)

FOREIGN PATENT DOCUMENTS

CN 102072150 A 5/2011
CN 106122001 A 11/2016
(Continued)

OTHER PUBLICATIONS

German Search Report issued in German Application No. 10 2019 110 905.1, dated Mar. 17, 2020, 7 pages.
(Continued)

*Primary Examiner* — Theresa Trieu
(74) *Attorney, Agent, or Firm* — RatnerPrestia

(57) ABSTRACT

A vane cell pump, including: a delivery chamber having an inlet and an outlet; a rotor which is arranged in the delivery chamber and has a rotor body and vanes which are accommodated by the rotor body such that they can be shifted radially; an end-facing wall which delineates the delivery chamber on an axial end-facing side; and a supporting element which is arranged axially between the end-facing wall and the rotor body and which supports the vanes at their radially inner vane ends, wherein the rotor body, the supporting element and each two vanes which are adjacent in the circumferential direction of the rotor form chambers, the volume of which varies when the rotor is rotating. A pressure equalization connection fluidically connects at least two of the chambers to each other.

12 Claims, 5 Drawing Sheets

(51) Int. Cl.

| | |
|---|---|
| ***F04C 2/00*** | (2006.01) |
| ***F04C 14/22*** | (2006.01) |
| ***F04C 2/344*** | (2006.01) |
| ***F04C 15/00*** | (2006.01) |

(58) Field of Classification Search
CPC ..... F04C 15/0065; F04C 15/008; F04C 15/0023; F04C 2210/14; F04C 2210/206
See application file for complete search history.

(56) References Cited

U.S. PATENT DOCUMENTS

| | | | | |
|---|---|---|---|---|
| 2004/0091381 | A1 | 5/2004 | Agner | |
| 2015/0252802 | A1* | 9/2015 | Imanaga et al. ..... | F04C 14/226 418/24 |
| 2018/0223840 | A1* | 8/2018 | Naganuma ..... | F04C 14/226 |

FOREIGN PATENT DOCUMENTS

| | | | | |
|---|---|---|---|---|
| DE | 102005040702 | A1 | 3/2007 | |
| DE | 102006036439 | A1 | 2/2008 | |
| DE | 102016205686 | A1 | 10/2017 | |
| DE | 112016003646 | T5 | 5/2018 | |
| GB | 14424 | A | 2/1910 | |
| WO | WO-2017026224 | A1 * | 2/2017 | ..... F04C 14/226 |

OTHER PUBLICATIONS

Chinese Office Action issued in Chinese Patent Application No. 202010333214.6, dated Oct. 9, 2021, with translation, 11 pages.
Extended European Search Report issued in European Patent Application No. 20 170 948.2, dated Aug. 31, 2020, with translation, 10 pages.

* cited by examiner

VANE CELL PUMP COMPRISING A PRESSURE EQUALIZATION CONNECTION

CROSS REFERENCE TO RELATED APPLICATION

This application claims priority to German Patent Application No. 10 2019 110 905.1, filed Apr. 26, 2019, the contents of such application being incorporated by reference herein.

FIELD OF THE INVENTION

The invention relates to a vane cell pump. The vane cell pump comprises: a delivery chamber for a fluid, comprising an inlet and an outlet; a rotor which is arranged in the delivery chamber and comprises a rotor body and vanes which are accommodated by the rotor body such that they can be shifted radially; an end-facing wall which delineates the delivery chamber on an axial end-facing side; and a supporting element which is arranged axially between the end-facing wall and the rotor body and which supports the vanes at their radially inner vane ends, wherein the rotor body, the supporting element and each two vanes which are adjacent in the circumferential direction of the rotor form chambers, the volume of which varies when the rotor is rotating.

SUMMARY OF THE INVENTION

An aspect of the invention is in particular based on providing a cheap vane cell pump which exhibits a long service life.

An aspect of the invention relates to an adjustable vane cell pump, comprising: a delivery chamber comprising an inlet and an outlet; a rotor for delivering a fluid, which is arranged in the delivery chamber and comprises a rotor body and vanes which are accommodated by the rotor body such that they can be shifted radially; an end-facing wall which delineates the delivery chamber on an axial end-facing side; and a supporting element which is arranged axially between the end-facing wall and the rotor body and which supports the vanes at their radially inner vane ends and which presses or pushes the radially outer vane ends against a delivery chamber wall. The rotor body, the supporting element and each two vanes which are adjacent in the circumferential direction form chambers, the volume of which varies when the rotor is rotating or driven. In accordance with an aspect of the invention, the vane cell pump comprises a pressure equalization connection which connects at least two of the chambers to each other fluidically or in terms of fluidics.

A surface of the rotor body pointing axially outwards, a surface of the rotor body pointing radially inwards, a surface of the end-facing wall pointing axially inwards, a surface of the supporting element pointing radially outwards, a surface of a vane pointing in the rotational direction of the rotor, and a surface of an adjacent vane pointing counter to the rotational direction of the rotor, wherein the surfaces of the vanes face each other, preferably delineate a chamber which is formed between the rotor body, the supporting element and each two vanes which are adjacent in the circumferential direction. The pressure equalization connection advantageously connects at least one chamber which decreases in size ("contracts") when the rotor is rotating to at least one chamber which increases in size ("enlarges") when the rotor is rotating. The pressure equalization connection preferably establishes a fluid exchange between at least two of the chambers which is greater, advantageously at least two times greater, than a fluid exchange when the pressure equalization connection is absent, which only results or can result from component clearances. The terms "radially" and "axially" refer in particular to a rotational axis of the rotor, such that the expression "axially" denotes a direction which extends on or parallel to the rotational axis, and the expression "radially" denotes a direction which extends perpendicular to the rotational axis. The term "circumferential direction" refers in particular to the rotational axis of the rotor, such that the term "circumferential direction" denotes a direction which extends around the rotational axis, advantageously pointing in and/or counter to the rotational direction of the rotor.

A fluid which is enclosed or situated in the chambers can be specifically exchanged between the chambers through the pressure equalization connection in accordance with an aspect of the invention, thus enabling the fluid compressed in the contracting chamber to escape into another chamber, advantageously into an enlarging chamber. A pressure difference, in particular between an enlarging chamber and a contracting chamber, can thus be equalized between the two chambers. This can relieve, reduce or avoid high pressures in the chambers, thus enabling the load exposure of the supporting element, the vanes, the rotor body and/or the delivery chamber wall to be reduced in a particularly simple way. This can reduce the wear on the supporting element, the vanes, the rotor and/or the delivery chamber wall, thus enabling a cheap vane cell pump which exhibits a long service life to be provided.

The rotor body and the upper side of the end-facing wall which faces the rotor body form an axial sealing gap. The upper side of the end-facing wall which faces the rotor body is an inner side of the axial end-facing wall which faces the delivery chamber. The supporting element forms another axial sealing gap with the end-facing wall, wherein the axial sealing gap which is formed between the supporting element and the end-facing wall is arranged radially inside the axial sealing gap which is formed between the rotor body and the end-facing wall.

The axial sealing gap and the other axial sealing gap are preferably annular and for example circular. A diameter of the axial sealing gap which is formed between the end-facing wall and the rotor body is greater than a diameter of the axial sealing gap which is formed between the end-facing wall and the supporting element.

The axial sealing gap which is formed between the rotor body and the end-facing wall preferably separates the chambers which are formed by the rotor body, the supporting element and each two vanes of the rotor which are adjacent in the circumferential direction and the delivery cells which are formed by the rotor body, the delivery chamber wall and each two vanes of the rotor which are adjacent in the circumferential direction, from each other, in particular fluidically.

The chambers which are formed by the rotor body, the supporting element and each two vanes which are adjacent in the circumferential direction are formed radially inside the axial sealing gap which is formed between the rotor body and the end-facing wall. The chambers which are formed by the rotor body, the supporting element and each two vanes which are adjacent in the circumferential direction are formed radially outside the axial sealing gap which is formed between the supporting element and the end-facing wall. The chambers which are formed by the rotor body, the supporting element and each two vanes which are adjacent in the circumferential direction are delineated by the vanes radially inside the rotor body in the circumferential direction. The rotor body, the delivery chamber wall and each two vanes which are adjacent in the circumferential direction form the delivery cells. The delivery cells which are formed by the rotor body, the delivery chamber wall and each two vanes which are adjacent in the circumferential direction are formed radially outside the axial sealing gap which is formed between the rotor body and the end-facing wall. The delivery cells which are formed by the rotor body, the delivery chamber wall and each two vanes which are adjacent in the circumferential direction are delineated by the vanes radially outside the rotor body in the circumferential direction. The fluid is transported in the delivery cells from the inlet to the outlet. The pressure equalization connection in accordance with an aspect of the invention is preferably formed radially inside the axial sealing gap which is formed between the rotor body and the end-facing wall.

The vane cell pump can in particular comprise a base and a cover, wherein the base and the cover each comprise or form an end-facing wall as described above. The vane cell pump preferably comprises a setting ring, for adjusting an eccentricity between the rotor and the delivery chamber and therefore for adjusting the delivery volume, which comprises or forms the delivery chamber wall which radially delineates the delivery chamber. The supporting element advantageously presses or pushes the vanes against the delivery chamber wall of the setting ring. The delivery chamber wall preferably forms a running surface for the radially outer vane ends of the vanes. The delivery chamber wall is preferably formed as an inner circumferential wall of the setting ring. In order to adjust the delivery rate, the setting ring can be mounted such that it can be shifted, rotated or pivoted.

The pressure equalization connection can comprise at least one groove in the end-facing wall and/or a groove in at least one of the vanes and/or at least one passage hole in one of the vanes and/or an enlarged sealing gap between the supporting element and the end-facing wall and/or an enlarged sealing gap between at least one of the vanes and the end-facing wall. The pressure equalization connection connects at least two chambers to each other in terms of fluidics, such that different fluid pressures in the chambers, which can for example occur due to the different chamber volume, are advantageously equalized. A groove exhibits a depth or an axial extent which is greater, advantageously at least 50% and particularly advantageously at least 100% greater, than the axial sealing gap which is formed between the rotor body and the end-facing wall, and/or greater than the axial sealing gap which is formed between the supporting element and the end-facing wall.

In order to form the pressure equalization connection, an enlarged axial sealing gap is greater, advantageously at least 50% and particularly advantageously at least 100% greater, than the axial sealing gap which is formed between the rotor body and the end-facing wall, and/or greater than an axial sealing gap which is formed between a vane and the end-facing wall, in particular radially outside the rotor body. The enlarged axial sealing gap in a region of the chambers which is formed between a vane and the end-facing wall inside the rotor body can be realized by reducing the axial extent of the vane, wherein the axial extent is only reduced at the radially inner vane end and therefore on the radial side of the vane which faces away from the delivery chamber wall or the setting ring. The vane therefore exhibits different axial extents as viewed along its radial extent. At its radially inner vane end, the vane for example comprises a step, an oblique surface, a chamfer, a rounded surface, etc. The reduced axial extent and/or the step, oblique surface, etc. is preferably not situated radially outside the axial sealing gap which is formed between the rotor body and the end-facing wall in any rotational position of the rotor and/or any setting position of the setting ring.

At least one axial end of the rotor body can be formed in the shape of a cup or can comprise an accommodating space for the supporting element which is open towards the end-facing wall. The axial end of the rotor body comprises an axially protruding edge which faces the end-facing wall. The axially protruding edge radially surrounds the accommodating space and therefore the supporting element. The supporting element is arranged radially inside the axially protruding edge. The surface of the axially protruding edge pointing axially outwards forms an annular running surface of the rotor body which together with the end-facing wall forms the axial sealing gap which is formed between the rotor body and the end-facing wall. The groove can be formed in the side of the end-facing wall which faces the rotor body. It is preferably open towards the rotor. The supporting element is preferably arranged in the accommodating space which is delineated by the cup-shaped axial end and/or the axially protruding edge of the rotor body and the end-facing wall. A groove exhibits a depth or an axial extent which is smaller than a depth or axial extent of the accommodating space and/or the supporting element, advantageously half, preferably less than half of the depth or axial extent of the accommodating space and/or the supporting element.

The rotor can be mounted in the cover and/or in the base in a bearing. The vane cell pump can comprise a drive shaft, for driving the rotor, which is rotary-mounted in the cover and/or the base in at least one bearing, such as for example a slide bearing.

The groove in the end-facing wall is open towards the accommodating space. The groove in the end-facing wall can be formed by a circle, a circular segment or multiple separate circular segments. The groove preferably extends concentrically with respect to the rotational axis of the rotor, wherein the groove in the end-facing wall extends radially at least substantially outside the supporting element, preferably outside the region surrounded by the supporting element. The separate circular segments can lie on one circular line or on different circular lines which are differently spaced from the rotor axis/drive shaft.

A groove or annular groove which is formed as a circle preferably exhibits a uniform width and depth. If the groove consists of multiple separate circular segments, each circular segment preferably exhibits a uniform width and depth, wherein the width and/or depth of a first separate circular segment can differ from the width and/or depth of another separate circular segment. Individual separate circular segments or all of the separate circular segments can exhibit a width and/or depth which vary/varies over the extent of the separate circular segment. The separate circular segment can transition into the surface surrounding it at the beginning and end in the longitudinal direction of the circular segment abruptly, in the shape of a step or gently. Individual separate circular segments, in particular when the separate circular segments lie on different circular lines, can be connected to each other by a channel.

The end-facing wall preferably comprises at least two sealing stays which axially face the rotor and which each separate the inlet from the outlet or a low-pressure region from a high-pressure region of the delivery chamber. The sealing stays are each arranged between the inlet and the outlet as viewed along the rotational direction of the rotor.

The sealing stays are preferably arranged oppositely. One of the sealing stays is formed in the region of maximum delivery cell volume, in particular at full delivery and therefore maximum eccentricity. The other sealing stay is formed in a region of minimum delivery cell volume, in particular at full delivery and therefore maximum eccentricity, and is also referred to as the driving stay. The pressure equalization connection, in particular the groove in the end-facing wall, preferably connects at least one chamber at one sealing stay and at least one chamber at the other sealing stay to each other.

The pressure equalization connection does not connect the delivery cells to each other. It only connects, to each other, the chambers which are formed radially inside the axially protruding edge of the rotor body between the rotor body, two vanes which are adjacent in the circumferential direction, and the supporting element. The axially protruding edge of the rotor isolates the chambers and the delivery cells from each other.

The groove in the end-facing wall which is formed by the cover and/or the base is preferably separated or isolated from the inlet which is formed in the cover and/or in the base. The groove in the end-facing wall which is formed by the cover and/or the base is preferably separated or isolated from the outlet which is formed in the cover and/or in the base. The groove in the end-facing wall which is formed by the cover and/or the base is preferably separated or isolated from the bearing of the rotor and/or drive shaft in the cover and/or base. In particular, the groove in the end-facing wall does not feed into the inlet, the outlet or the bearing, either in the cover or in the base. The groove in the end-facing wall preferably extends radially inside the inlet and outlet and radially outside the bearing. The groove preferably extends radially between the inlet/outlet and the bearing. The groove in the end-facing wall advantageously extends radially at a distance from the inlet, the outlet and the bearing.

In order to accommodate the vanes such that they can be shifted radially, the rotor body can comprise vane receptacles which each comprise a slot region, in which the vane is guided, and a base region which preferably radially adjoins the slot region and in which the vane is not guided. The base region forms a radially inner region of the vane receptacle and can have a shape which deviates from the slot shape of the slot region and can for example be round. The base region is arranged radially inside the axial sealing gap which is formed between the rotor body and the end-facing wall. It is formed radially between the bearing and the axial sealing gap which is formed between the rotor body and the end-facing wall. The groove in the end-facing wall is separated or isolated from the base region of the vane receptacles. The groove preferably does not feed into any of the base regions of the vane receptacles. The groove in the end-facing wall preferably extends radially outside the base region of the vane receptacles. The groove in the end-facing wall advantageously extends radially between the base region of the vane receptacles and the axial sealing gap which is formed between the rotor body and the end-facing wall.

The base regions of the vane receptacles each comprise a base which forms a radially inner end of the respective vane receptacle. The groove in the end-facing wall is preferably spaced radially from the base of the vane receptacles. The groove in the end-facing wall advantageously extends radially outside the base of the vane receptacles. The groove in the end-facing wall advantageously extends radially between the base of the vane receptacles and the axial sealing gap which is formed between the rotor body and the end-facing wall.

As already mentioned, the vane cell pump can comprise a setting ring using which the delivery rate of the vane cell pump can be varied. The setting ring can form the delivery chamber. If the vane cell pump comprises a setting ring, then the setting ring can preferably at least partially form the delivery chamber wall against which the vanes are tensed by the supporting element. The setting ring can be any known device using which the delivery volume of a vane cell pump can be varied; this device need not have an annular shape.

The vane cell pump is in particular designed to be used in a motor vehicle. It is formed as a motor vehicle pump. The vane cell pump is preferably designed for delivering a liquid, in particular a lubricant, coolant and/or actuating agent. It is formed as a liquid pump. The vane cell pump is preferably designed for supplying, lubricating and/or cooling a motor vehicle drive motor or a motor vehicle transmission. The liquid is preferably embodied as an oil, in particular an engine lubricating oil or a transmission oil. The vane cell pump can be formed as an engine lubricant pump for a motor vehicle or as a transmission pump for a motor vehicle.

BRIEF DESCRIPTION OF THE DRAWINGS

In the following, an example embodiment of a vane cell pump in accordance with an aspect of the invention is described in more detail on the basis of figures. Features essential to an aspect of the invention which can only be gathered from the figures form part of the scope of the invention.

The figures show.

DETAILED DESCRIPTION OF THE INVENTION

Figure 1:
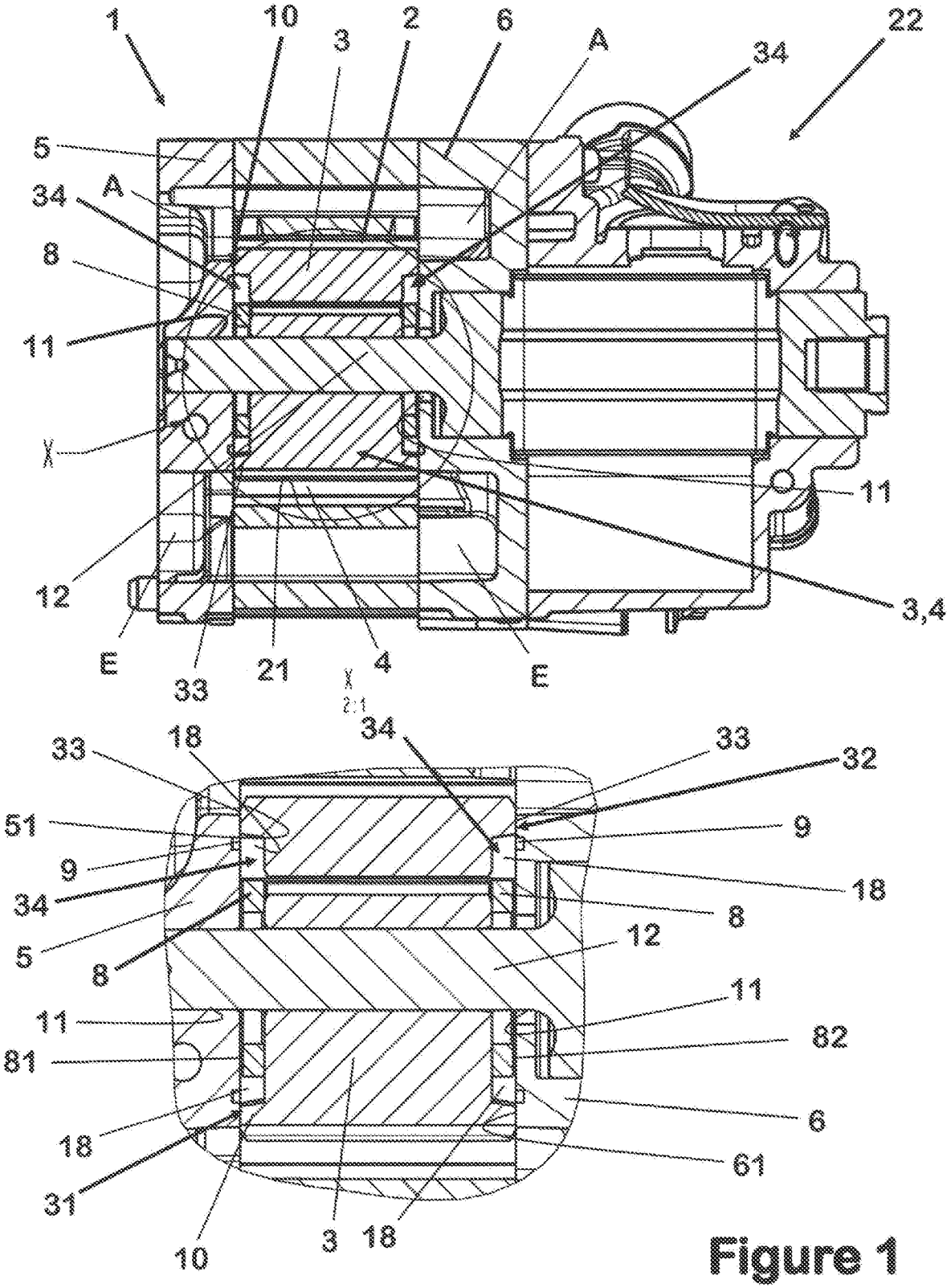
FIG. 1 a longitudinal section of a tandem pump comprising a vane cell pump in accordance with an aspect of the invention, plus the detailed view X.

FIG. 1 shows a longitudinal section of a tandem pump of a motor vehicle comprising a vane cell pump 1 and another pump 22 which are driven by a common drive shaft 12. The vane cell pump 1 can be formed as an engine lubricating oil pump, and the other pump 22 can be formed as a vacuum pump. An aspect of the invention is not restricted to arranging the vane cell pump 1 in a tandem pump. Forming it as a tandem pump, and how the other pump 22 is formed, is not relevant to performing an aspect of the invention. The vane cell pump 1 can readily be formed as an independent pump, for example as an engine lubricating oil pump.

The vane cell pump 1 comprises a rotor 3, 4 comprising a rotor body 3 and vanes 4 which are accommodated by the rotor body 3 such that they can be shifted radially. The rotor 3, 4 is arranged in a delivery chamber 2. The delivery chamber 2 comprises a delivery chamber wall 21 which forms a running surface for the radially outer vane ends of the vanes 4. The vane cell pump 1 comprises a drive shaft 12 which is non-rotationally connected to the rotor 3, 4 and to a drive which is not presented in more detail. The rotor 3, 4 can be driven about its rotational axis by the drive.

The vane cell pump 1 comprises a first end-facing wall 5 and a second end-facing wall 6 which axially delineate the delivery chamber 2 on one end-facing side each. The first end-facing wall 5 is formed by a base or a base plate. The second end-facing wall 6 is formed by a cover or a cover plate.

The axial ends of the rotor body 3 are formed in the shape of a cup, such that each of the axial ends of the rotor body 3 forms an annular, axially protruding edge 33 which progresses on a running surface 51 of the end-facing wall 5 at the base end and/or a running surface 61 of the end-facing wall 6 at the cover end when the rotor 3, 4 is driven. The axially protruding edge 33 of the first axial end of the rotor body 3 forms an axial sealing gap 31 with the running surface 51 of the end-facing wall 5 at the base end. The axially protruding edge 33 of the second axial end of the rotor body 3 forms an axial sealing gap 32 with the running surface 61 of the end-facing wall 6 at the cover end. By being formed in the shape of a cup, each of the axial ends of the rotor body 3 comprises an accommodating space 34 which is surrounded by the axially protruding edge 33 of the respective end. The accommodating space 34 is designed for accommodating or arranging a supporting element 8 for supporting the vanes 4.

The vane cell pump 1 comprises a pressure equalization connection 10 which in the example embodiment shown comprises a groove 9 which is formed in the upper side of the end-facing wall 5 and end-facing wall 6, which faces the rotor body 3.

The axial sealing gaps 31, 32 isolate the respective accommodating space 34 in which the supporting element 8 is arranged. The supporting element 8 forms an axial sealing gap 81 with the end-facing wall 5 at the base end and/or a sealing gap 82 with the end-facing wall 6 at the cover end. The supporting element 8, the rotor body 3, each two vanes 4 which are adjacent in the circumferential direction of the rotor 3, 4, and the respective end-facing wall 5, 6 form chambers 18 or rotor interior space chambers in the accommodating space 34, the volume of which varies periodically when the rotor 3, 4 is driven. The groove 9 of the pressure equalization connection 10 connects at least two adjacent chambers 18 to each other, such that pressure equalization occurs between these chambers 18. The groove 9 is formed as a closed annular groove. It fluidically connects all the chambers 18 permanently to each other. The groove 9 can however also be formed as one or more circular segments, such that only selected chambers 18 are connected to each other.

The vane cell pump 1 also comprises an inlet E which is assigned to a low-pressure side of the vane cell pump 1 and through which fluid can flow into the delivery chamber 2. The fluid can leave the delivery chamber 2 again through an outlet A which is assigned to a high-pressure side of the vane cell pump 1.

Figure 2:
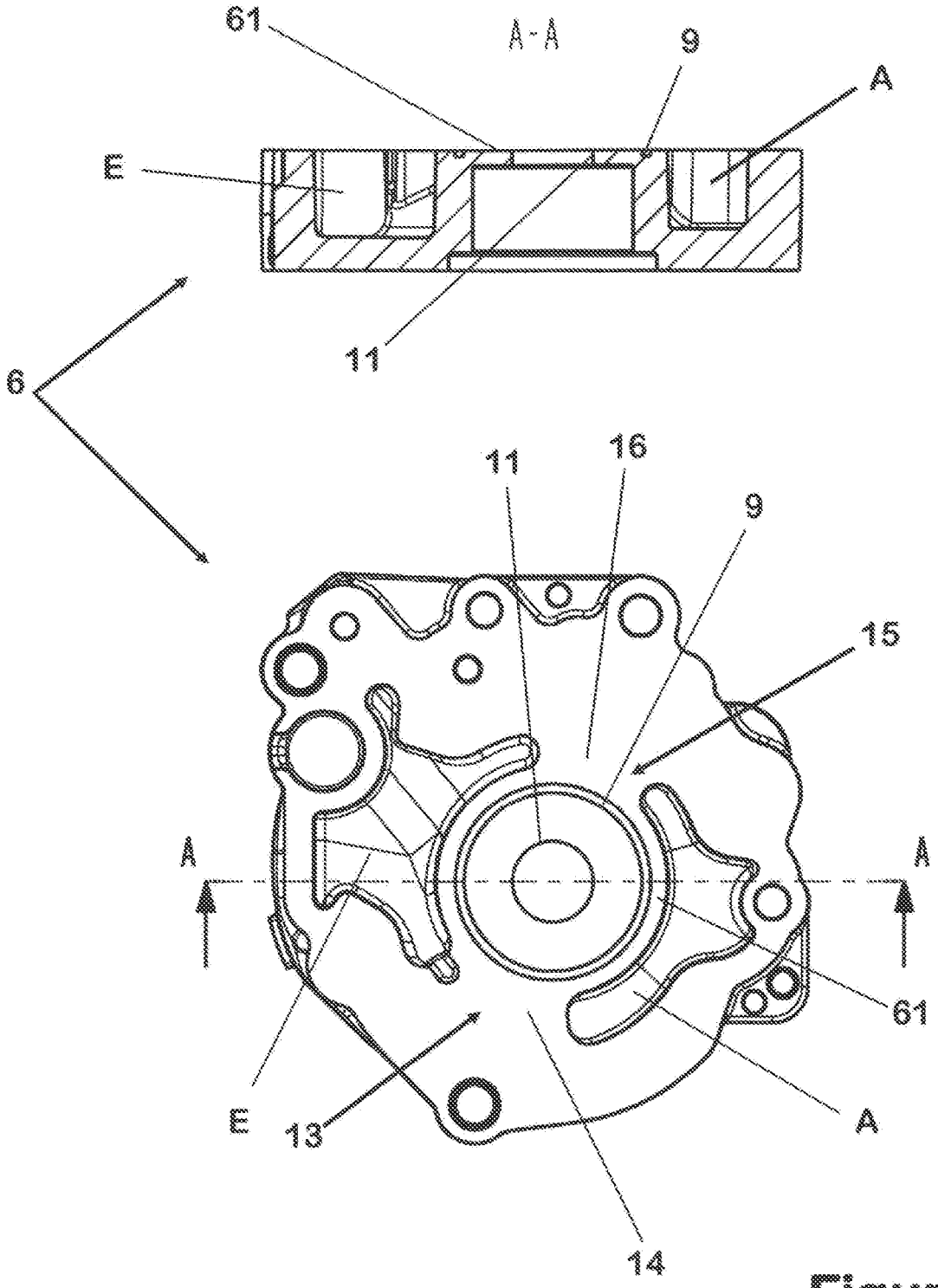
FIG. 2 a plan view and a longitudinal section of an end-facing wall at the cover end of the vane cell pump.

FIG. 2 shows a longitudinal section and a plan view of the end-facing wall 6 at the cover end or, respectively, the upper side of the end-facing wall 6 which faces the rotor 3, 4. The running surface 61 for the rotor body 3, the inlet E, the outlet A and the bearing 11 for the drive shaft 12 can be seen in FIG. 2. The groove 9, which is formed in the upper side of the end-facing wall 6 which faces the rotor 3, 4, can also be seen.

A first sealing stay 13 comprising a crest 14, and a second sealing stay 15 comprising a crest 16, can also be seen in the plan view. The groove 9 is formed as a continuous annular groove which does not feed into either the inlet E, the outlet A or the bearing 11. The pressure equalization connection 10, in this case the groove 9, connects all the chambers 18 to each other in the example embodiment shown. The groove 9 can however also be formed as one or more separate circular portions. A circular portion can then for example extend only from the crest 16 of the sealing stay 15 up to the crest 14 of the sealing stay 13. This does not connect all the chambers 18 to each other, but does connect the smallest chamber 18 and the largest chamber 18, thus enabling the pressure in the smallest chamber 18, i.e. the chamber 18 exposed to the greatest load, to be relieved.

Figure 3:
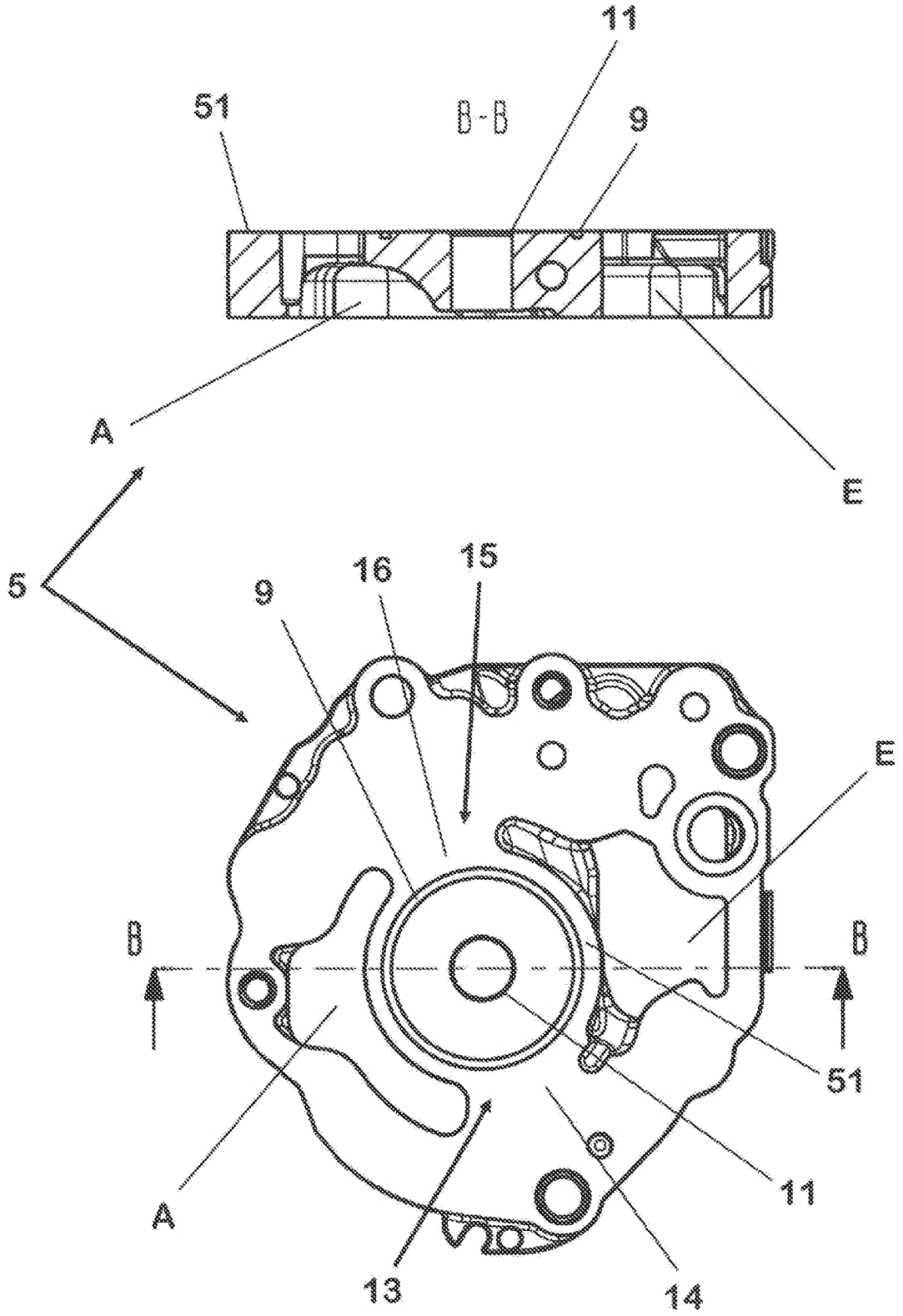
FIG. 3 a plan view and a longitudinal section of an end-facing wall at the base end of the vane cell pump.

FIG. 3 shows substantially the same as FIG. 2, this time embodied on the end-facing wall 5 at the base end. Reference is therefore made to the description of FIG. 2, which shows the same features as FIG. 3.

Figure 4:
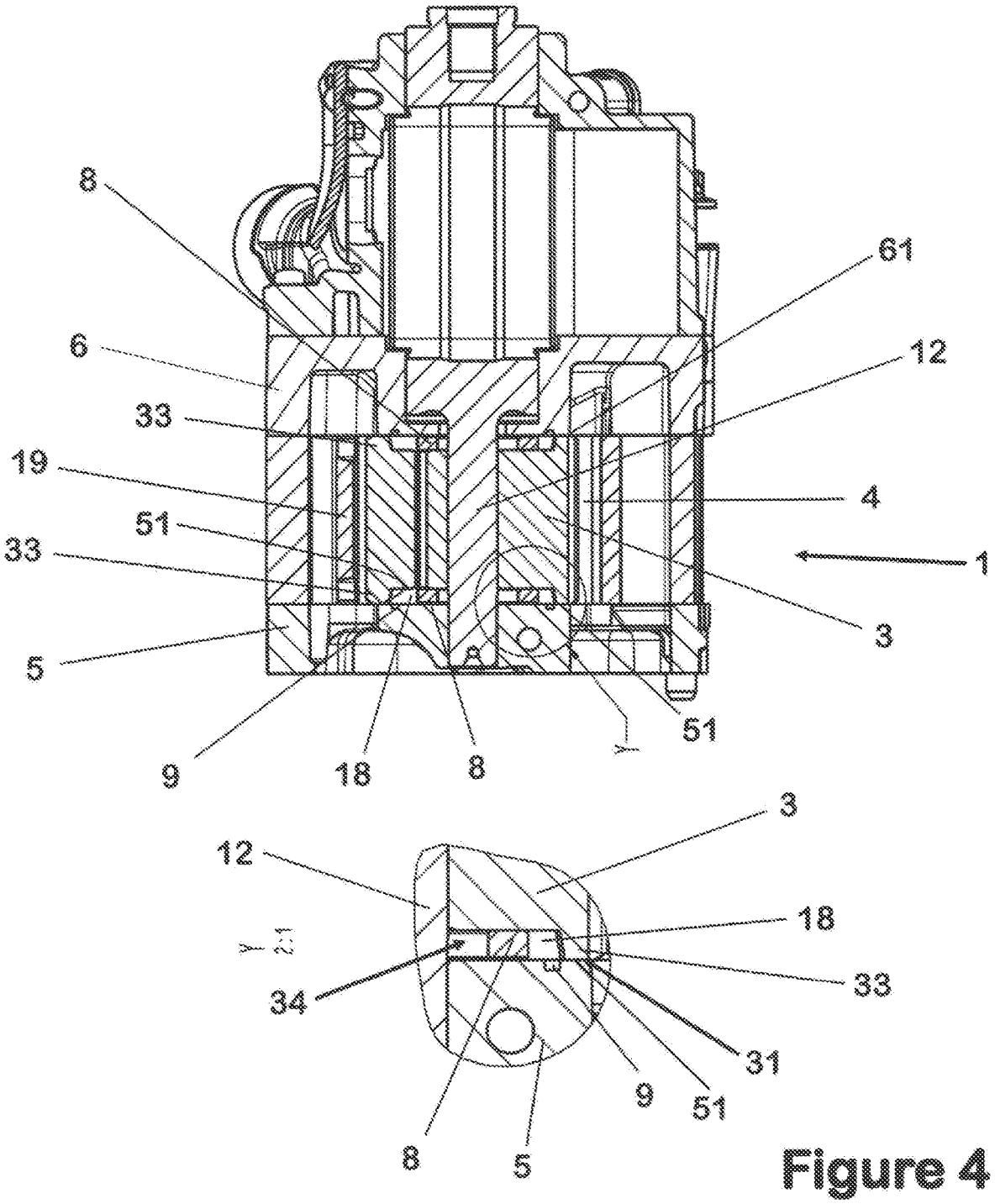
FIG. 4 the longitudinal section of FIG. 1 together with the detailed view Y.

FIG. 4 shows the vane cell pump of FIG. 1 together with the setting ring 19 using which the delivery amount of the vane cell pump 1 can be adjusted. The setting ring 19 forms the delivery chamber wall 21. The delivery chamber wall 21 forms a running surface for the radially outer vane ends of the vanes 4. The vane cell pump 1 comprises an end-facing wall 6 on which the axially protruding edge 33 of the rotor body 3 progresses along the running surface 61 at the first axial end, and an axially opposite end-facing wall 5 on which the axially opposite, axially protruding edge 33 of the rotor body 3 progresses along the running surface 51 at the second axial end.

The detail shows the axial sealing gap 31 which the edge 33 of the rotor body 3 forms with the upper side of the end-facing wall 5 which faces the rotor body 3. The supporting element 8 is arranged in the accommodating space 34 and, together with the rotor body 3 and two vanes 4 which are adjacent in the circumferential direction of the rotor 3, 4, forms the chambers 18 which are fluidically connected to each other by the pressure equalization connection 10, in this case the groove 9, such that pressure equalization occurs between the chambers 18.

Figure 5:
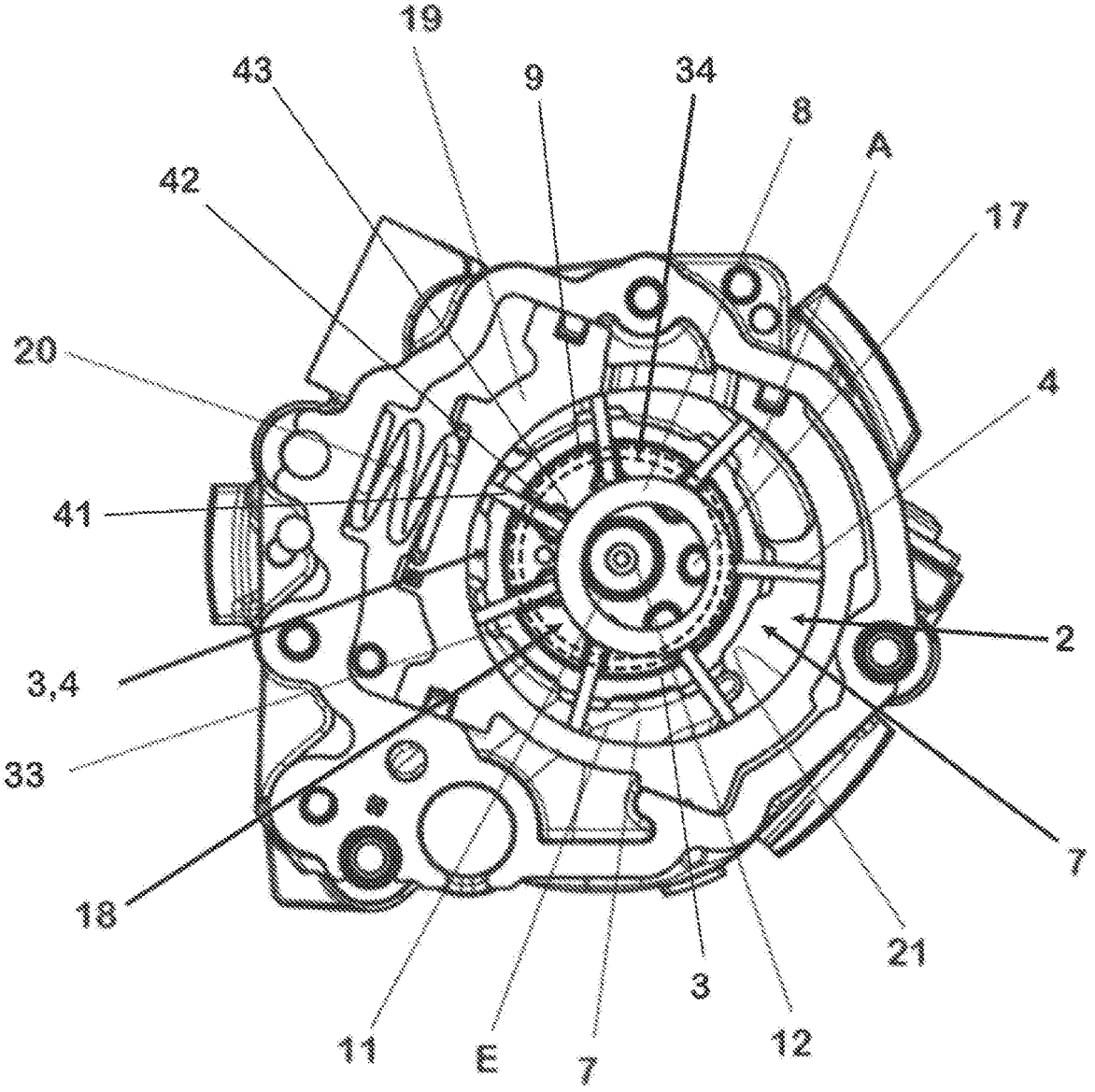
FIG. 5 a plan view of the vane cell pump with the end-facing wall at the base end absent.

FIG. 5 is a view into a vane cell pump 1 showing the setting ring 19 which is biased towards maximum eccentricity between the rotor 3, 4 and the setting ring 19, i.e. full delivery, by a spring element 20. In order to adjust the setting ring 19 and therefore the delivery rate, the setting ring 19 can be hydraulically adjusted, against the spring force of the spring element 20, by a setting pressure in a setting chamber. The rotor 3, 4 comprising the axially protruding edge 33, which forms the axial sealing gap 31 with the end-facing wall 5 at the base end along the running surface 51, can be seen. The rotor 3, 4 comprises vanes 4 which are pressed or pushed against the delivery chamber wall 21 of the delivery chamber 2 by the supporting element 8 in every setting position of the setting ring 19. The vanes 4 sub-divide the delivery chamber 2 into delivery cells 7 in which fluid can be transported from the inlet E to the outlet A. The rotor body 3 also comprises vane receptacles 41 which comprise a slot region 42 and a base region 43 comprising a base 17.

The supporting element 8, two vanes 4 which are adjacent in the circumferential direction of the rotor 3, 4, and the rotor body 3 form the chambers 18, the volume of which varies when the rotor 3, 4 is rotating. The pressure equalization connection 10 in the form of the groove 9 is indicated in FIG. 5 by dashed lines. The groove 9 lies in the accommodating space 34 which is radially delineated by the axially protruding edge 33 of the rotor body 3, and outside the base regions 43 of the vane receptacles 41. The groove 9 does not feed into any of the base regions 43 of the vane receptacles 41. It extends radially between the axially protruding edge 33 and the base region 43.

LIST OF REFERENCE SIGNS

1 vane cell pump
2 delivery chamber
21 delivery chamber wall
3 rotor body
31 sealing gap
32 sealing gap
33 edge
34 accommodating space
4 vane
41 vane receptacle
42 slot region
43 base region
5 end-facing wall
51 running surface
6 end-facing wall
61 running surface
7 delivery cell
8 supporting element
81 sealing gap
82 sealing gap
9 groove
10 pressure equalization connection
11 bearing
12 drive shaft
13 sealing stay
14 crest
15 sealing stay
16 crest
17 base
18 chamber
19 setting ring
20 spring element
22 pump
A outlet
E inlet

The invention claimed is:

1. A vane cell pump, comprising:

a. a delivery chamber comprising an inlet and an outlet;

b. a rotor which is arranged in the delivery chamber and comprises a rotor body and vanes which are accommodated in a radially shiftable manner by the rotor body;

c. an end-facing wall which delineates the delivery chamber on an axial end-facing side;

d. a supporting element which is arranged axially between the end-facing wall and the rotor body and which supports the vanes at their radially inner vane ends, e. a delivery chamber wall which forms a running surface for the radially outer vane ends of the vanes, f. wherein the rotor body, the delivery chamber wall and each two vanes which are adjacent in the circumferential direction form delivery cells which are delineated by the vanes radially outside the rotor body in the circumferential direction and transport fluid from the inlet to the outlet, g. wherein the rotor body, the supporting element and each two vanes which are adjacent in the circumferential direction of the rotor form chambers, the volume of which varies when the rotor is rotating, and h. wherein an axially protruding edge of the rotor isolates the chambers and the delivery cells from each other, and i. a pressure equalization connection which connects at least two of the chambers to each other fluidically which are formed radially inside the axially protruding edge, j. wherein the pressure equalization connection comprises at least one groove formed in one or both of (i) the end-facing wall or in the rotor axially adjacent to the vanes, and (ii) at least one of the vanes.

2. The vane cell pump according to claim 1, wherein the rotor body and the end-facing wall form an axial sealing gap, and wherein the pressure equalization connection is formed radially inside the axial sealing gap.

3. The vane cell pump according to claim 1, wherein the at least one groove is formed in the end-facing wall or in the rotor by a circle, a circular segment or multiple separate circular segments, concentrically with respect to a rotational axis of the rotor.

4. The vane cell pump according to claim 1, wherein the at least one groove is separated from one or both of the inlet and the outlet.

5. The vane cell pump according to claim 1, further comprising a drive shaft, for driving the rotor, which is mounted in at least one bearing, wherein the at least one groove is separated from the bearing.

6. The vane cell pump according to claim 1, wherein in order to accommodate the vanes in a radially shiftable manner, the rotor body comprises vane receptacles which each comprise a base which forms a radially inner end of the vane receptacle, wherein the at least one groove is spaced radially from the base of the vane receptacles.

7. The vane cell pump according to claim 6, wherein the at least one groove extends radially outward from the base of the vane receptacles.

8. The vane cell pump according to claim 1, wherein the at least one groove extends radially outward from at least substantially outside the supporting element.

9. The vane cell pump according to claim 1, wherein the vane cell pump is an engine lubricant pump of a motor vehicle or a transmission pump of a motor vehicle.

10. A vane cell pump, comprising:

a. a delivery chamber comprising an inlet and an outlet;

b. a rotor which is arranged in the delivery chamber and comprises a rotor body and vanes which are accommodated in a radially shiftable manner by the rotor body;

c. an end-facing wall which delineates the delivery chamber on an axial end-facing side;

d. a supporting element which is arranged axially between the end facing wall and the rotor body and which supports the vanes at their radially inner vane ends, e. a delivery chamber wall which forms a running surface for the radially outer vane ends of the vanes, f. wherein the rotor body, the delivery chamber wall and each two vanes which are adjacent in the circumferential direction form delivery cells which are delineated by the vanes radially outside the rotor body in the circumferential direction and transport fluid from the inlet to the outlet, g. wherein the rotor body, the supporting element and each two vanes which are adjacent in the circumferential direction of the rotor form chambers, the volume of which varies when the rotor is rotating, and h. wherein an axially protruding edge of the rotor isolates the chambers and the delivery cells from each other, and i. a pressure equalization connection which connects at least two of the chambers to each other fluidically which are formed radially inside the axially protruding edge, j. wherein the pressure equalization connection comprises at least one passage hole in at least one of the vanes.

11. A vane cell pump, comprising:

a. a delivery chamber comprising an inlet and an outlet;

b. a rotor which is arranged in the delivery chamber and comprises a rotor body and vanes which are accommodated in a radially shiftable manner by the rotor body;

c. an end-facing wall which delineates the delivery chamber on an axial end-facing side;

d. a supporting element which is arranged axially between the end facing wall and the rotor body and which supports the vanes at their radially inner vane ends, e. a delivery chamber wall which forms a running surface for the radially outer vane ends of the vanes, f. wherein the rotor body, the delivery chamber wall and each two vanes which are adjacent in the circumferential direction form delivery cells which are delineated by the vanes radially outside the rotor body in the circumferential direction and transport fluid from the inlet to the outlet, g. wherein the rotor body, the supporting element and each two vanes which are adjacent in the circumferential direction of the rotor form chambers, the volume of which varies when the rotor is rotating, and h. wherein an axially protruding edge of the rotor isolates the chambers and the delivery cells from each other, and i. a pressure equalization connection which connects at least two of the chambers to each other fluidically which are formed radially inside the axially protruding edge, j. wherein the pressure equalization connection comprises one or both of (i) an enlarged axial sealing gap between the supporting element and the end-facing wall and (ii) an enlarged axial sealing gap between at least one of the vanes and the end-facing wall.

12. The vane cell pump according to claim 11, wherein the rotor body and the end-facing wall form an axial sealing gap, and wherein the one or both of the enlarged axial sealing gap between the supporting element and the end-facing wall and the enlarged axial sealing gap between the at least one of the vanes and the end-facing wall is/are at least 50% wider than the axial sealing gap which is formed between the rotor body and the end-facing wall.

* * * * *